United States Patent [19]

Abel

[11] 4,099,861

[45] Jul. 11, 1978

[54] CONTAMINATION SENSOR

[75] Inventor: Frank Bernard Abel, Spencerport, N.Y.

[73] Assignee: Eastman Kodak Company, Rochester, N.Y.

[21] Appl. No.: 740,527

[22] Filed: Nov. 10, 1976

[51] Int. Cl.[2] ..... G03G 21/00

[52] U.S. Cl. ..... 355/15; 15/339

[58] Field of Search ..... 15/319, 339; 323/21; 340/237 P, 239 F; 355/15; 250/215

[56] References Cited

U.S. PATENT DOCUMENTS

| | | | |
|---|---|---|---|
| 2,982,950 | 5/1961 | Boyle | 340/237 S |
| 3,585,621 | 6/1971 | DiCello | 340/237 S |
| 3,804,512 | 4/1974 | Komori et al. | 355/15 X |
| 3,949,234 | 4/1976 | Vandermark | 340/237 S |
| 4,021,879 | 5/1977 | Brigham | 15/319 |
| 4,038,594 | 7/1977 | Quinn et al. | 323/21 X |

*Primary Examiner*—A. D. Pellinen
*Attorney, Agent, or Firm*—Lawrence P. Kessler

[57] ABSTRACT

A contamination sensor for monitoring exhaust path of the cleaning apparatus of an electrophotographic copier/duplicator to determine a malfunction condition in the cleaning apparatus. The sensor includes a light emitting diode (LED) placed in the exhaust path of the cleaning apparatus downstream of the final filter thereof and an optical sensor positioned to view the LED. The optical sensor produces a signal dependent upon the concentration of particulate toner in the exhaust path. The optical sensor is connected to the inverting input of a integrated circuit comparator wherein the signal from the optical sensor is compared to a reference signal. When the reference signal is exceeded, a circuit breaker is opened to give an appropriate alarm and/or shut down the copier/duplicator.

7 Claims, 2 Drawing Figures

CONTAMINATION SENSOR

BACKGROUND OF THE INVENTION

1. Field of the Invention

Figure 1:
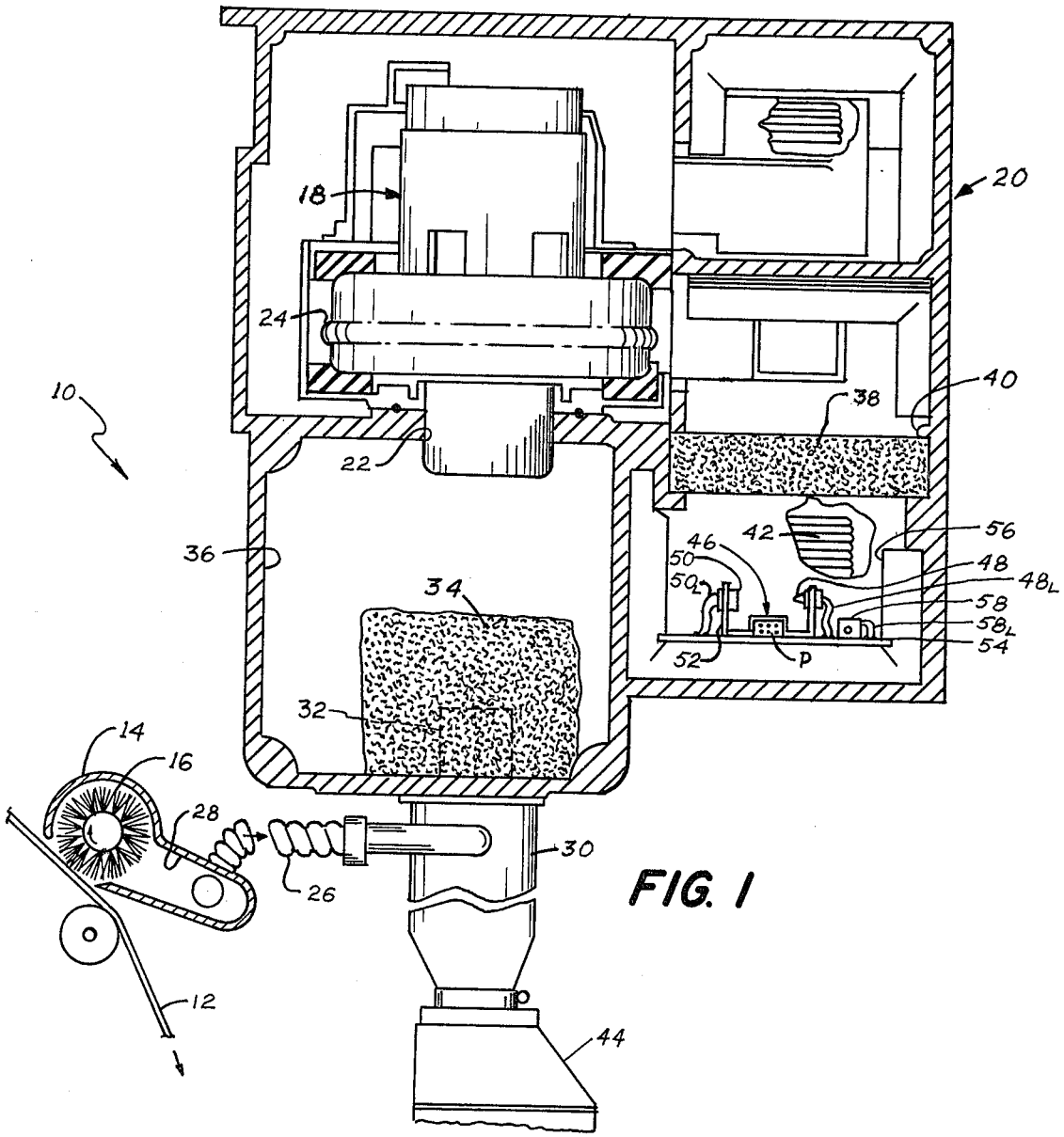

This invention relates to cleaning apparatus for electrophotographic copier/duplicators, and more particularly to a mechanism for sensing an overload to the cleaning apparatus and accordingly shutting down the copier/duplicator.

2. Description of the Prior Art

Modern high speed electrophotographic copier/duplicators make document reproductions by exposing an electrically charged photoconductive member to a light image of the document to be copied. The light image selectively discharges the photoconductive member to form a latent image charge pattern on the member corresponding to the document. An oppositely charged developer material is brought into contact with the latent image to develop the image. Subsequently the developed image is transferred to a receiver sheet and fixed to the sheet by heat and/or pressure to yield the desired reproduction.

The developer material is generally a resinous powder referred to as toner. In transferring the toner to the receiver sheet, because of the nature of the material, it is virtually impossible to make a complete transfer. If the residual toner material is not removed from the photoconductive member prior to reusing the member, subsequent images formed on the member will be degraded; moreover, the toner material may scatter throughout the copier/duplicator to contaminate the internal structure of the copier apparatus to adversely effect its overall operation. Therefore, it is desireable to include apparatus for cleaning the photoconductive member immediately after transfer of the image from the photoconductive member to the receiver sheet.

Typical apparatus for cleaning the photoconductive member of an electrophotographic copier/duplicator are shown and described in U.S. Pat. Nos. 3,615,813 and 3,838,922 and Research Disclosure Bulletin, Vol. No. 143 at Page 20, (published by Industrial Opportunities, Ltd., Homewell, Havant, Hampshire, P09 1EF, U.K.), the publication entitled "Electrophotographic Copier Erase and Cleaning Apparatus". Briefly, the cleaning apparatus include a rotating brush contacting the photoconductive surface. A vacuum atmosphere surrounds the brush and draws toner material swept up by the brush through a filter arrangement. Under adverse circumstances, it is possible for the filter to become overloaded with toner material. When this occurs the material may be blown out into the copier/duplicator or its surrounding work space creating a hazardous condition for the machine, its operator, and the surrounding environment.

SUMMARY OF THE INVENTION

It is the purpose of this invention to provide a mechanism for monitoring the cleaning apparatus of an electrophotographic copier/duplicator and sensing an overload thereof to shut down the copier/duplicator. The mechanism includes an LED placed in the exhaust path of the cleaning apparatus downstream of the final filter thereof and an optical sensor positioned to view the LED. The optical sensor produces a signal dependent upon the concentration of particulate toner material in the exhaust path. The optical sensor is connected to the inverting input of an integrated circuit comparator wherein the signal from the optical sensor is compared to a reference signal. As soon as the cleaning apparatus becomes overloaded, toner material will begin to permeate the filter and become entrained in the air stream through the exhaust path. The ability of the optical sensor to "see" the LED will immediately begin to become impaired. The degree to which the optical sensor's view becomes impaired is, of course, directly related to the concentration of toner material in the exhaust. Thus, through the comparator circuit, the amount of light reaching the optical sensor (and accordingly the concentration of toner material in the exhaust path) can be determined. At a given set point, a signal from the optical sensor will exceed the reference signal and a signal may be produced indicative of a particular concentration of toner material in the cleaning apparatus exhaust. This latter signal may then be used to open a circuit breaker to an appropriate alarm and/or shut down the copier/duplicator.

BRIEF DESCRIPTIONS OF THE DRAWINGS

Figure 2:
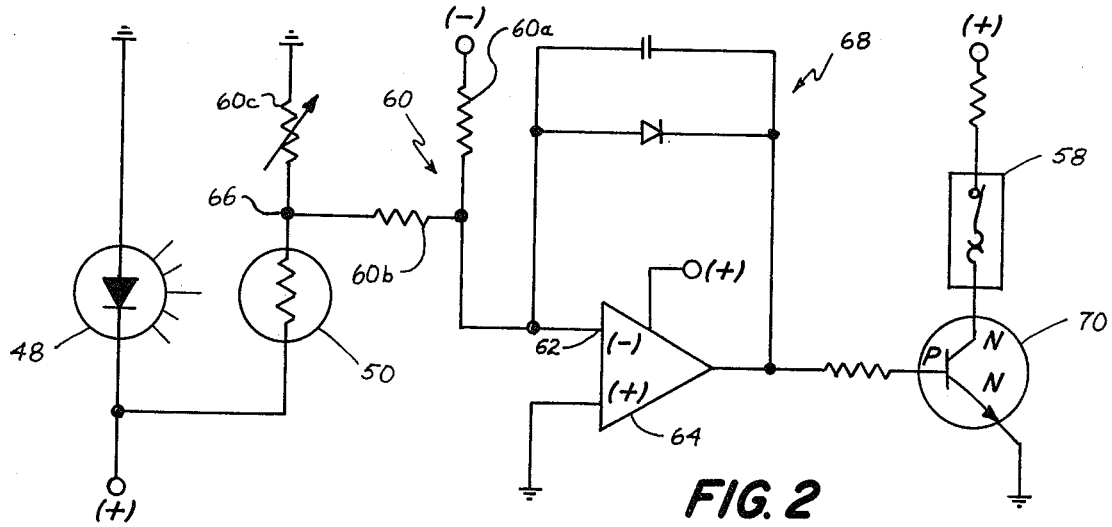

In the detailed descriptions of the preferred embodiment of the invention presented below, reference is made to the accompanying drawings in which:

FIG. 1 is a side elevational view, partly in section of a cleaning apparatus for an electrophotographic copier/duplicator incorporating the contamination sensor of this invention; and FIG. 2 is a schematic view of the electronic circuitry of the contamination sensor of this invention.

Referring now to the drawings, an exemplary cleaning apparatus 10 for a photoconductor web 12 of an electrophotographic copier/duplicator is shown in FIG. 1. As noted above, the cleaning apparatus is fully described in Research Disclosure Bulletin, Vol. 143 at page 20. The description is repeated herein only to the extent necessary for a complete understanding of the instant invention, it being understood that cleaning apparatus of different configurations could be substituted without departing from the the scope of this invention. The cleaning apparatus 10 includes a housing 14 within which a pliable bristle brush 16 is rapidly rotated. The rotation of the brush is in a direction such that the bristles are moving in opposition to the web 12 at the point of contact with the web. The speed of the brush 16 within the housing 14 creates a "vacuum cleaner" type action to provide for efficient sweeping up of any loose particulate toner material on the web 12 into the housing 14.

A vacuum is established within the housing 14 for removing the cleaned toner material by a vacuum motor 18 in flow communication with the housing. The motor 18 is mounted in a muffler box 20, which is divided into a series of baffle chambers and has leaded-foam insulation to reduce motor and air stream noise. The air passage between intake 22 to blower 24 of the vacuum motor 18 and the cleaning brush housing 14 incudes a flexible hose 26 connected at one end to a manifold section 28 of the housing 14 and at the other end to a cyclone separator 30. The air stream from the outlet 32 of the cyclone separator 30 passes through a filter bag 34 in the chamber 36 of the muffler box 20 and thence enters the blower intake 22. The air from the blower 24 passes through a final filter 38 in the chamber 40 before passing to the atmosphere through the ports 42 in the wall of the chamber 40.

The particulate toner material is thus swept from the web 12 and entrained in the air stream generated by the vacuum motor 18. The particle laden air stream passes through the cyclone separator 30 wherein most of the particles (approximately 95%) are separated out of the air stream falling into a toner collection bottle 44. The remaining entrained particles are removed from the air stream by the filter bag 34 and the final filter 40. However, under certain adverse circumstances, the cyclone separator may fail in its function of removing the particulate toner material from the air stream. When this occurs the filter bag 34 and the final filter 40 are unable to absorb the additional particulate material load and toner particles may be permitted to be carried from the muffler box 20 to the atmosphere. Therefore, to protect the operation of the electrophotographic copier/duplicator and the surrounding environment, a contamination sensor 46 is provided to automatically shut down the copier/duplicator and/or give an appropriate alarm when a malfunction condition occurs and excess toner particles are detected in the air stream.

The contamination sensor 46 utilizes a radiant energy emitting device, such as an LED 48, and a photoresistor, such as a photocell 50, to view the air stream. The sensor 46 is located just prior to the exit of the air stream from the muffler box 20 to the atmosphere to determine the concentration of particulate toner material in the exiting air stream. The LED 48 and the photocell 50 are mounted in opposing relationship on a U-shaped bracket 52. The bracket 52 is fixed to a circuit board 54 which is force-fitted into the leaded-foam insulation 56 within the chamber 40 of the muffler box 20. Leads $48_L$ and $50_L$ electrically connect the LED 48 and the photocell 50, respectively, to the circuit board 54. A resetable circuit breaker 58 is also electrically connected (via leads $58_L$) to the circuit board 54. It is, of course, clear that a lamp or other appropriate alarm may be added to the circuit board or substituted for the breaker 58. A pin socket P is integrally connected to the circuit board for coupling the circuit board into the electrical control circuitry for the copier/duplicator.

The circuitry of the board 54 (shown schematically in FIG. 2) serves to electrically shut down the copier/duplicator when a predetermined concentration of toner particulate material is carried by the air stream through the chamber 40. It will be understood that a number of different circuits could be used to test for such an excess toner particle concentration without departing from the scope of the invention. The operation of the representative circuitry is as follows: The LED 48 disposed in the chamber 40 is connected to a source of positive potential and illuminates the photocell 50. The photocell 50 is connected to a voltage divider network 60 which includes two fixed resistors **60*a* and 60*b* and an adjustable resistor 60*c*. Resistor 60*a* is coupled to a source of negative potential. The voltage divider network 60 normally has a negative voltage between resistors 60*a* and 60*b* at the inverting input 62 of an operational amplifier 64. By adjusting resistor 60*c*, a positive set point voltage is placed on the reference junction 66 of the circuit. A clamping circuit 68 normally maintains 0 volts as the input to the base electrode of transistor 70 thereby causing it to be cut off. As the concentration of particulate toner material in the air stream increases, the light from the LED 48 reaching the photocell 50 will be reduced. As a result, the resistance of the photocell 50 will increase, thus increasing the negative voltage at the inverting input 62. When the negative voltage is increased to the point to exceed a selected threshold level, the operational amplifier 64 is gated on and produces a positive voltage output. The threshold level is representative of a predetermined maximum acceptable concentration of particulate matter in the air stream. The positive voltage output from the operational amplifier 64 turns on the transistor 70 causing sufficient current to flow through the circuit breaker 58 resulting in the opening of the breaker. Since the breaker 58** is coupled to the copier/duplicator control, the opening thereof causes the copier/duplicator control to be interrupted to shut down the copier and/or turn on an appropriate alarm, whereby egress of toner material of the environment will be prevented.

From the foregoing it is apparent that there is herein provided a sensor for shutting down an electrophotographic copier/duplicator (or sending out an appropriate alarm) when the cleaning apparatus of the copier/duplicator malfunctions and becomes overloaded or otherwise fails to efficiently remove particulate toner material from the cleaning air stream exiting from the copier/duplicator. A photocell views an LED in the air stream and turns on a transistor through an operational amplifier when a threshold level is exceeded. The threshold level is representative of the predetermined maximum acceptable concentration of particulate matter in the air stream. The transistor causes a sufficient current to flow through a circuit breaker opening the breaker thus shutting down the copier/duplicator and/or turning on an appropriate alarm.

The invention has been described in detail with particular reference to a preferred embodiment thereof, but it will be understood that variations and modifications can be effected within the spirit and scope of the invention.

I claim:

1. In a cleaning apparatus for removing particulate toner material from the photoconductive member of an electrophotographic copier, said cleaning apparatus including means for generating an air stream to entrain the removed particulate toner material and means for separating the entrained particulate toner material from the air stream, sensor means for determining an abnormal condition in said cleaning apparatus, said sensor means comprising:

means for producing a first signal indicative of the concentration of particulate toner material entrained in said air stream, said first signal producing means being located in the air stream downstream of said separating means and said generating means;

means for producing a reference signal representative of an abnormal concentration of particulate toner material; and means for comparing said first signal with said reference signal, said comparing means including means for producing a second signal when said first signal exceeds said reference signal and means responsive to said second signal for shutting down the electrophotographic copier.

2. The invention of claim 1 wherein said first signal producing means comprises:

a support mounted in said air stream downstream of said separating means and said generating means; emitting means positioned in said support for emitting a radiant energy signal through said air stream; and receiving means positioned in said support opposite said emitting means for receiving said radiant energy signal passing through said air stream, the level of said radiant energy signal as received by said receiving means being reduced in direct proportion to the amount of particulate toner material in said air stream, said receiving means being responsive to the level of said radiant energy signal as received for producing said first signal which is inversely proportional to the received level of said radiant energy signal.

3. The invention of claim 2 wherein said emitting means is a light emitting diode and said receiving means is a photocell.

4. The invention of claim 2 wherein said second signal producing means comprises: an operational amplifier having a threshold level representative of abnormal concentration of particulate toner material in said air stream, a clamping circuit normally maintaining the output of said operational amplifier at zero, and circuit means coupled to said receiving means for turning said operational amplifier on to produce said second signal when said first signal from said receiving means exceeds the threshold level.

5. The invention of claim 4 wherein said means for shutting down the electrophotographic copier comprises: a circuit breaker interconnected with the electrophotographic copier control, said circuit breaker being operatively coupled to said operational amplifier so as to be opened upon the production of said second signal by said operational amplifier.

6. A method of determining a malfunction condition in a vacuum cleaning apparatus for an electrophotographic copier, and shutting down the electrophotographic copier upon the occurrence of such malfunction condition, said method including the steps of:

determining the concentration of particulate toner material in the air stream of the vacuum cleaning apparatus immediately upstream of point at which said air stream passes into the environment surrounding said electrophotographic copier;

comparing the concentration of particulate toner material in the air stream with a predetermined maximum permissible concentration of particulate toner material in the air stream; and shutting down the electrophotographic copier when the determined concentration of particulate toner material exceeds the predetermined maximum permissible concentration of particulate material.

7. The invention of claim 6 further including the step of providing an alarm when said particulate toner material in the air stream exceeds the predetermined maximum permissible concentration of particulate toner material.

* * * * *